US010290976B2

(12) United States Patent
Holweg et al.

(10) Patent No.: US 10,290,976 B2
(45) Date of Patent: May 14, 2019

(54) ELECTRICAL CONNECTOR ASSEMBLY

(71) Applicant: Aptiv Technologies Limited, St. Michael (BB)

(72) Inventors: Harald Holweg, Henfenfeld (DE); Satheeshkumar Kumaran, Chennai (IN); Partheeban Loganathan, Chennai (IN)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 15/949,262

(22) Filed: Apr. 10, 2018

(65) Prior Publication Data

US 2018/0316138 A1 Nov. 1, 2018

(30) Foreign Application Priority Data

Apr. 27, 2017 (EP) ..... 17168498

(51) Int. Cl.

| | |
|---|---|
| ***H01R 13/15*** | (2006.01) |
| ***H01R 13/639*** | (2006.01) |
| ***H01R 13/627*** | (2006.01) |
| ***H01R 13/193*** | (2006.01) |
| *H01R 13/11* | (2006.01) |
| *H01R 13/631* | (2006.01) |
| *H01R 13/64* | (2006.01) |

(52) U.S. Cl.

CPC ..... *H01R 13/639* (2013.01); *H01R 13/193* (2013.01); *H01R 13/6271* (2013.01); *H01R 13/6272* (2013.01); *H01R 13/111* (2013.01); *H01R 13/112* (2013.01); *H01R 13/631* (2013.01); *H01R 13/64* (2013.01); *H01R 2201/26* (2013.01)

(58) Field of Classification Search

CPC ..... H01R 13/639; H01R 13/6272
USPC ..... 439/357, 358, 263, 261
See application file for complete search history.

(56) References Cited

U.S. PATENT DOCUMENTS

| | | | | |
|---|---|---|---|---|
| 2,075,632 A * | 3/1937 | Zuckerman | H01R 13/193 | 439/222 |
| 4,023,881 A * | 5/1977 | Migneau | H01R 13/193 | 439/261 |
| 4,449,778 A * | 5/1984 | Lane | H01R 9/032 | 439/607.47 |
| 6,416,345 B1 * | 7/2002 | Endo | H01R 13/6272 | 439/352 |
| 6,666,719 B1 * | 12/2003 | Kuroi | H01R 9/032 | 439/607.19 |

(Continued)

FOREIGN PATENT DOCUMENTS

| | | |
|---|---|---|
| DE | 102007014065 A1 | 10/2008 |
| DE | 102014215562 A1 | 2/2016 |
| WO | 2013092193 A1 | 6/2013 |

*Primary Examiner* — Abdullah A Riyami
*Assistant Examiner* — Nelson R. Burgos-Guntin
(74) *Attorney, Agent, or Firm* — Robert J. Myers

(57) ABSTRACT

An electrical connector for airbag restraint systems comprises an elongated housing aligned on a longitudinal axis, surrounding at least one elongated terminal having a contact surface, a terminal support device, attached on the elongated housing and movable longitudinally along the elongated housing from an open position to a support position. The terminal support device increases the contact pressure of the contact surface to a counter-contact element when the connector is mated to a counter-connector and the terminal support device is in the support position.

14 Claims, 5 Drawing Sheets

(56) References Cited

U.S. PATENT DOCUMENTS

| | | | | |
|---|---|---|---|---|
| 7,371,095 | B2 * | 5/2008 | Takahashi | H01R 4/5066 439/157 |
| 7,527,510 | B2 * | 5/2009 | Yoo | G02F 1/133604 439/232 |
| 7,828,585 | B2 * | 11/2010 | Kurimoto | H01R 13/02 439/357 |
| 8,636,532 | B2 * | 1/2014 | Masuda | G01N 27/4062 204/426 |
| 8,662,915 | B2 * | 3/2014 | Ueda | H01R 12/79 439/260 |
| 8,845,350 | B2 * | 9/2014 | Connell | G01R 11/04 439/268 |
| 9,218,919 | B2 * | 12/2015 | Connell | H01H 3/001 |
| 9,590,343 | B2 * | 3/2017 | Connell | G01R 11/04 |
| 2004/0147157 | A1 | 7/2004 | Burton | |
| 2013/0316563 | A1 | 11/2013 | Brandberg et al. | |
| 2016/0118745 | A1 * | 4/2016 | Droesbeke | H01R 13/4368 385/76 |
| 2017/0223276 | A1 * | 8/2017 | Iwai | H04N 5/23293 |
| 2018/0034175 | A1 * | 2/2018 | Lloyd | H01R 12/714 |

* cited by examiner

ELECTRICAL CONNECTOR ASSEMBLY

CROSS-REFERENCE TO RELATED APPLICATION

This application claims the benefit under 35 U.S.C. § 119(a) of Patent Application No. 17168498.8 filed in the European Patent Office on Apr. 27, 2017, the entire disclosure of which is hereby incorporated by reference.

TECHNICAL FIELD OF THE INVENTION

The present invention relates to an electrical connector assembly particularly useful with airbag restraint systems.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1B:
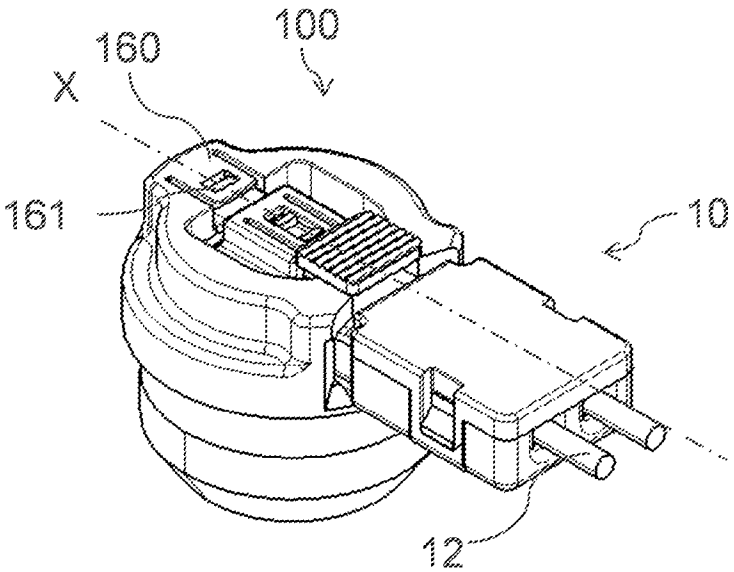
FIGS. 1*a* and 1*b* show schematic illustrations of a connector assembly in not connected and connected state in accordance with an embodiment of the invention.

An electrical connector 10 for airbag restraint systems comprising an elongated housing 20 aligned on longitudinal axis X, surrounding at least one elongated terminal 16 having a contact surface 17. Furthermore a terminal support device 50, attached on the elongated housing 20 and movable longitudinally, along the elongated housing 20, from an open position to a support position is presented in FIGS. 1A through 5. The terminal support device 50 increases the contact pressure of the contact surface 17, to a counter-contact element 111, when the connector is mated to a counter-connector 100 and the terminal support device 50 is in the support position.

Generally preferred, an electrical connector 10 assembly comprising a connector and a counter-connector 100, wherein the counter-connector 100 comprises a plane surface 110, arranged perpendicular to a counter-connector axis Z and along to the longitudinal axis X. A part of the counter-contact element 111 protrudes from the plane surface 110 along the counter-connector axis Z.

Preferably, the elongated housing 20 has an elongated opening 22 and the terminal support device 50 protrudes from the inside of the elongated housing 20, through the elongated opening 22, to outward the elongated housing 20. This allows to insert and operating the terminal support device 50 manually from the outside.

Preferably, the elongated housing 20 comprises a locking opening 161, arranged in a flexible tong 26. The terminal support device 50 comprises a first locking protrusion 52 and a second locking protrusion 54 protruding outward the elongated housing 20. The first locking protrusion 52 is located in the locking opening 161 when the terminal support device 50 is in the open position. The first locking protrusion 52 and the second locking protrusion 54 are located in the locking opening 161 when the terminal support device 50 is in the support position. This design allows an easy handling while attaching the terminal support device 50 to the connector as well as control of the terminal support device 50 in the two different positions.

Advantageously, the terminal support device 50 comprises a support protrusion 56 protruding perpendicular to the longitudinal axis X inward the elongated housing 20. The support protrusion 56 is optimized to be easy fitted inside the elongated housing 20 and cooperate with elongated terminals 16.

Preferably, the support protrusion 56 comprises a flat activation surface 58 for increasing said contact pressure and being aligned to the longitudinal axis X. This design gives the elongated terminals 16 some space to move perpendicular to the longitudinal axis X while connecting the connector to the counter-connector 100. In the support position the flat activation surface 58 interacts with the bend portion 19 to increase pressure to the contact surface 17.

Advantageously, the elongated terminal 16 comprises a straight portion 18 and a bend portion 19. In the support position the flat activation surface 58 interacts with the bend portion 19 to increase pressure to the contact surface 17. To control the level and behavior of the force the shape of the bended portion can be varied. The bend portion 19 can be carried out curved or stepped or angled.

Preferably, the flat activation surface 58 is arranged opposite the straight portion 18 when the terminal support device 50 is in the open position. The flat activation surface 58 contacts the bend portion 19 when the terminal support device 50 is in the support position. The flat portions guide each other while moving from one position to the other.

Advantageously, the elongated housing 20 comprises a bar 60, protruding in a mating direction along the longitudinal axis X, having a third locking protrusion 61 to lock the elongated housing 20 to a locking opening 161 in a flexible locking tong 160 of said counter-connector 100. The third locking protrusion 61 locks the connector safety to the counter-connector 100.

Preferably, the electrical connector 10 comprises two elongated terminals 16 and wherein the protrusion is arranged between the two elongated terminals 16. The elongated shape of the terminal makes the terminals flexible and leave room for fixing means to fix the terminals into the elongated housing 20. The position between the terminals makes it possible to operate both terminals by using only one protrusion.

Advantageously, a shroud 101 surrounds, at least partly, the at least one counter-contact element 111. The shroud 101 protects the counter-contact element 111 from destruction while manufacturing and provide means to hold and lock the connector.

Preferably, the length of the part of the at least one counter-contact element 111 protruding out of the plane surface 110, is less than 50% of the extension, of the shroud 101 from the plane surface 110, along the counter-connector axis Z. This makes a flat design of the connector assembly possible.

Advantageously, the plane surface 110 comprises at least one groove 104 aligned along the longitudinal axis X. The electrical connector 10 comprises at least one rib 32 aligned along the longitudinal axis X. The at least one rib 32 is carried in the at least one groove 104, when the connector and the counter-connector 100 are fully connected. The position and size of the rib 32 and the groove 104 allow a coding of connector to counter-connector 100 to make sure that only the correct connector can be connected to the counter-connector 100. Furthermore the groove 104 is also a guiding means for the rib 32 of the connector.

Preferably, the contact surface 17 of the at least one elongated terminal 16 is arranged in an angle outward to the longitudinal axis X and wherein the at least one counter-contact element 111 is pin shaped. The contact surface 17 works like a funnel for the counter-contact element 111.

Figure 1A:
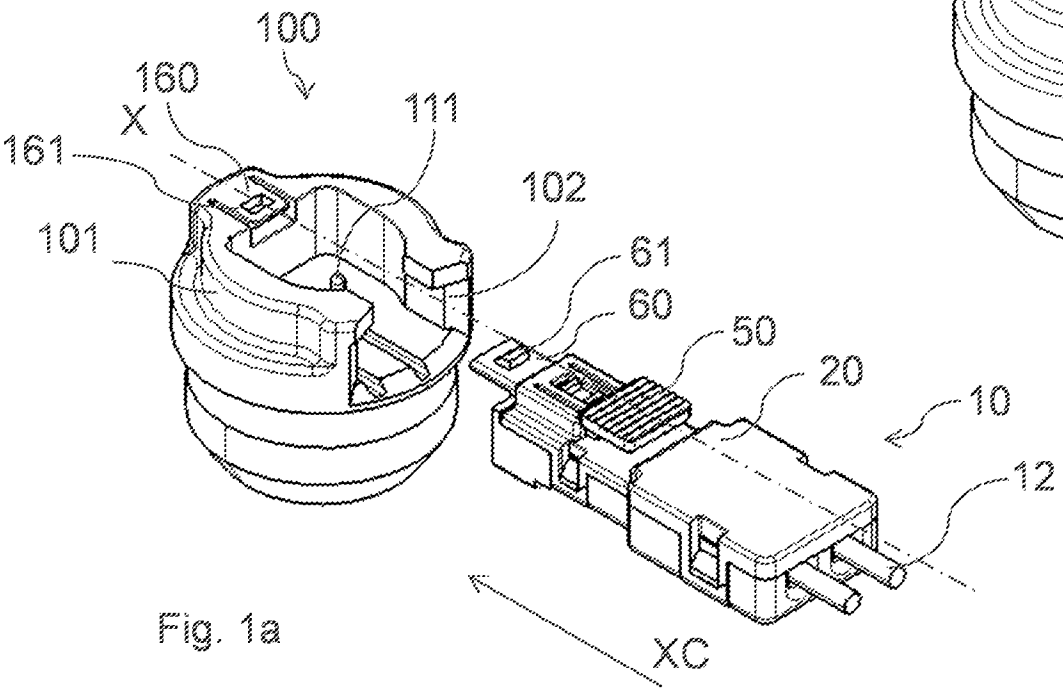

FIGS. 1*a* and 1*b* shows a perspective, three-dimensional view of an electrical connector 10 assembly in accordance with the invention. The electrical connector 10 comprises an elongated housing 20 that is aligned on longitudinal axis X. A terminal support device 50, attached on the elongated housing 20 and movable longitudinally along the elongated housing 20 from an open position O (FIG. 1*a*) to a support position C (FIG. 1*b*). The elongated housing 20 comprises a bar 60, protruding in a mating direction XC along the longitudinal axis X. The bar 60 is having a third locking protrusion 61 to lock the elongated housing 20 to a locking opening 161 in a flexible locking tong 160 of said counter-connector 100. Electrical wires 12 protrude, from the inside of the electrical connector 10 to the outside.

Figure 2:
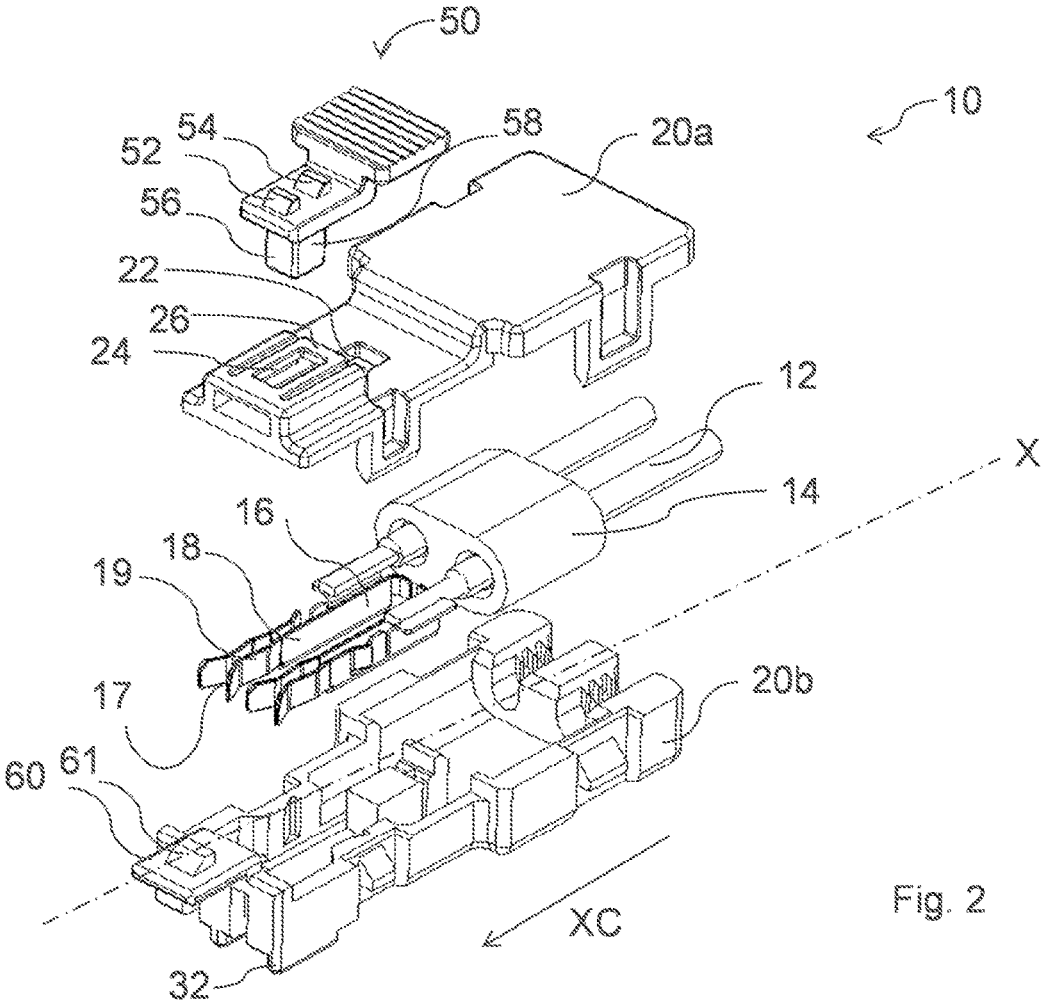
FIG. 2 shows an exploded illustration of the connector illustrated in FIGS. 1*a* and 1*b* in accordance with an embodiment of the invention.

FIG. 2 shows an exploded illustration of the electrical connector 10 illustrated in FIGS. 1*a* and 1*b*. An elongated housing 20, in this embodiment consisting from an upper part 20*a* and a lower part 20*b*, is aligned along longitudinal axis X. The elongated housing 20 surrounding an elongated terminal 16 having a contact surface 17. A terminal support device 50, is attachable on the elongated housing 20 to be movable longitudinally along the elongated housing 20 from an open position to a support position. The elongated housing 20 has an elongated opening 22 where the terminal support device 50 can protrude from the inside of the elongated housing 20 to outward the elongated housing 20. The elongated housing 20 comprises a locking opening 24, arranged in a flexible tong 26. The terminal support device 50 comprises a first locking protrusion 52 and a second locking protrusion 54, protruding outward the elongated housing 20. The first locking protrusion 52 is located in the locking opening 24 when the terminal support device 50 is in the open position O. The first locking protrusion 52 and the second locking protrusion 54 are located in the locking opening 24 when the terminal support device 50 is in the support position C. The terminal support device 50 comprises a support protrusion 56 protruding perpendicular to the longitudinal axis X inward the elongated housing 20. The support protrusion 56 comprises a flat activation surface 58 for increasing the contact pressure. The flat activation surface 58 is aligned to the longitudinal axis X. The elongated terminal 16 is aligned along the longitudinal axis X of the elongated housing 20. The elongated terminal 16 comprises a straight portion 18 and a bend portion 19. The flat activation surface 58 is arranged opposite the straight portion 18 when the terminal support device 50 is in the open position O. The flat activation surface 58 contacts the bend portion 19 when the terminal support device 50 is in the support position C. The elongated housing 20 comprises a bar 60, protruding in the mating direction XC along the longitudinal axis X. The bar 60 is having a third locking protrusion 61 to lock the elongated housing 20 to a locking opening 161 in a flexible locking tong 160 of said counter-connector 100 (FIG. 1*a*). The electrical connector 10 has two elongated terminals 16 and the support protrusion 56 is arranged between the two elongated terminals 16. Electrical wires 12 are guided through openings of a Ferrite body 14 and attached on the elongated terminals 16 to electrically connect the electrical wires 12 to the elongated terminals 16. In this embodiment the electrical wires 12 are connected by ultrasonic welding.

Figure 3A:
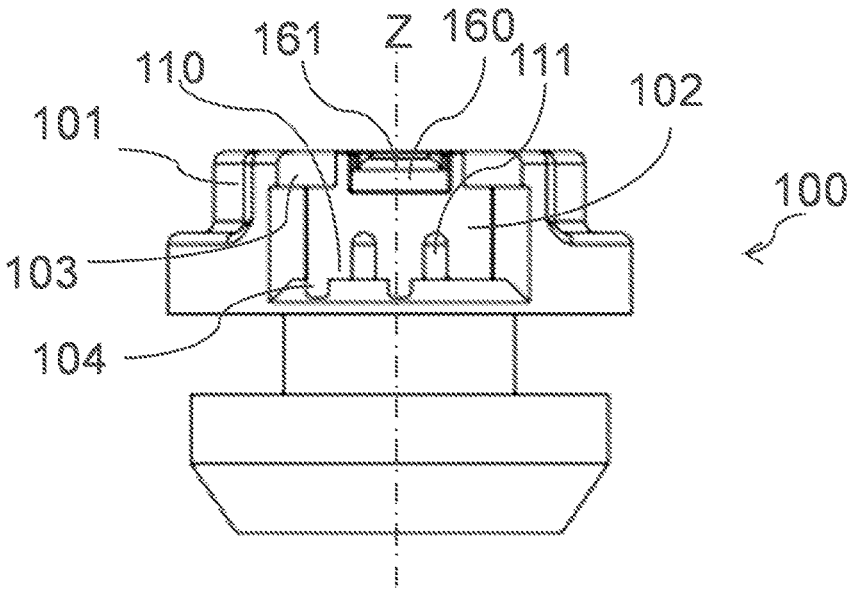
FIG. 3*a* shows a side view of the counter-connector in accordance with an embodiment of the invention.

FIG. 3*a* shows a side view of the counter-connector 100. The counter-connector 100 comprises a plane surface 110, arranged perpendicular to a counter-connector axis Z. A part of the counter-contact element 111 protrudes from the plane surface 110 along the counter-connector axis Z. A shroud 101 surrounds partly, the one counter-contact element 111. The length of the part of the counter-contact element 111 protruding out of the plane surface 110, is less than 50% of the extension, of the shroud 101 from the plane surface 110, along the counter-connector axis Z. The plane surface 110 comprises a groove 104, aligned along the longitudinal axis X. The electrical connector 10 comprises a rib 32 aligned along the longitudinal axis X (FIG. 2). The rib 32 is carried in the groove 104, when the electrical connector 10 and the counter-connector 100 are fully connected (FIG. 5).

Figure 3B:
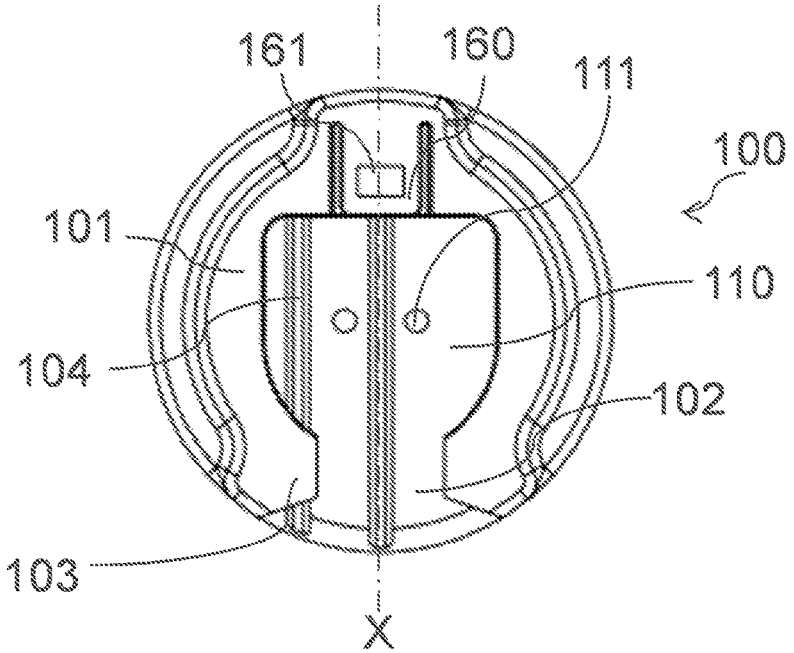
FIG. 3*b* shows a top view of the counter-connector in accordance with an embodiment of the invention.

FIG. 3*b* shows a top view of the counter-connector 100. The shroud 101 surrounds the plane surface 110 partly. The shroud 101 has a cutout 102 to allow insertion of the electrical connector 10. The cutout 102 has a shroud protrusion 103 on the end opposite the plane surface 110. The shroud protrusion 103 prevents movement of the connector in directions of the counter-connector axis Z, while insertion of the electrical connector 10. The electrical connector 10 can be inserted by moving the connector along the longitudinal axis X through the cutout 102 into the counter-connector 100. While moving, the rib 32 is guided in the groove 104.

Figure 4A:
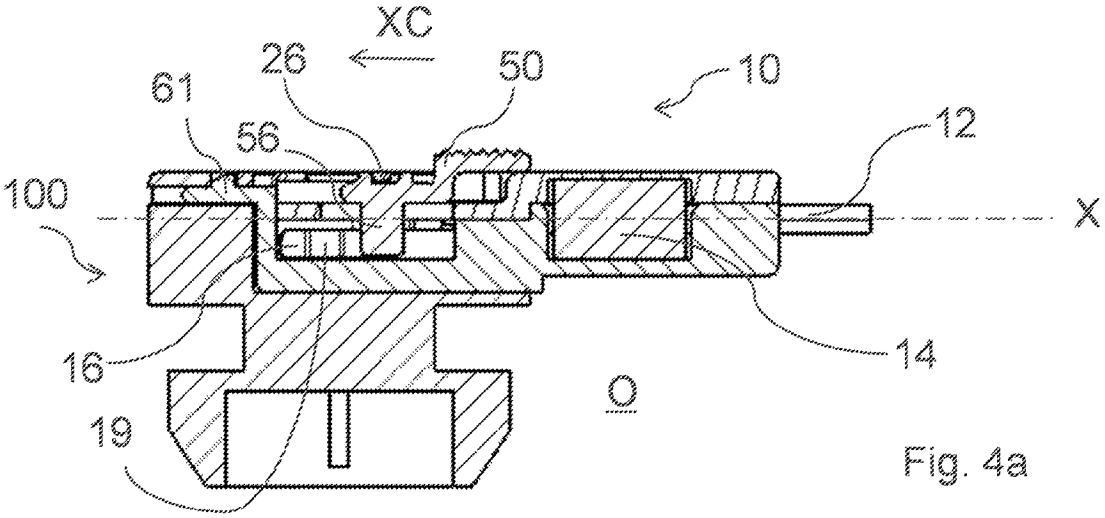
FIG. 4*a* shows a cut view of the connector assembly of FIG. 1*b* with a cut along the longitudinal axis, with the support device in an open position in accordance with an embodiment of the invention.
Figure 4B:
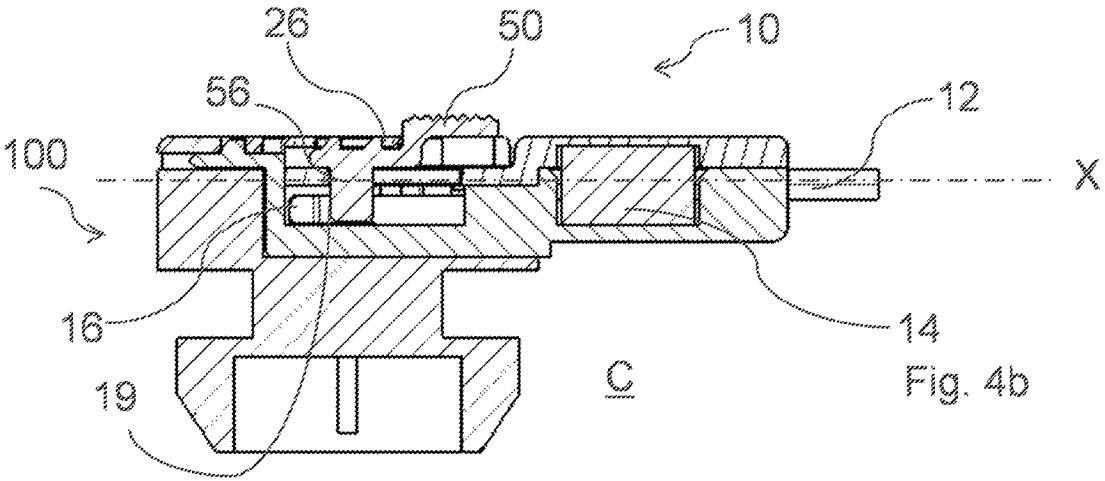
FIG. 4*b* shows a cut view of the connector assembly of FIG. 1*b* with a cut along the longitudinal axis, with the support device in a support position in accordance with an embodiment of the invention.

FIG. 4*a* shows a cut view of the connector assembly of FIG. 1*b* wherein the cut is executed along the longitudinal axis X. The electrical connector 10 is mechanically locked to the counter-connector 100 by the third locking protrusion 61 that is lock locked in the locking opening 161 of the counter-connector 100. The terminal support device 50 is in the open position O locked by the flexible tong 26. FIG. 4*b* shows the terminal support device 50 is locked in the support position C by the flexible tong 26. The support protrusion 56 is in contact with the bend portion 19 of the elongated terminal 16.

Figure 5:
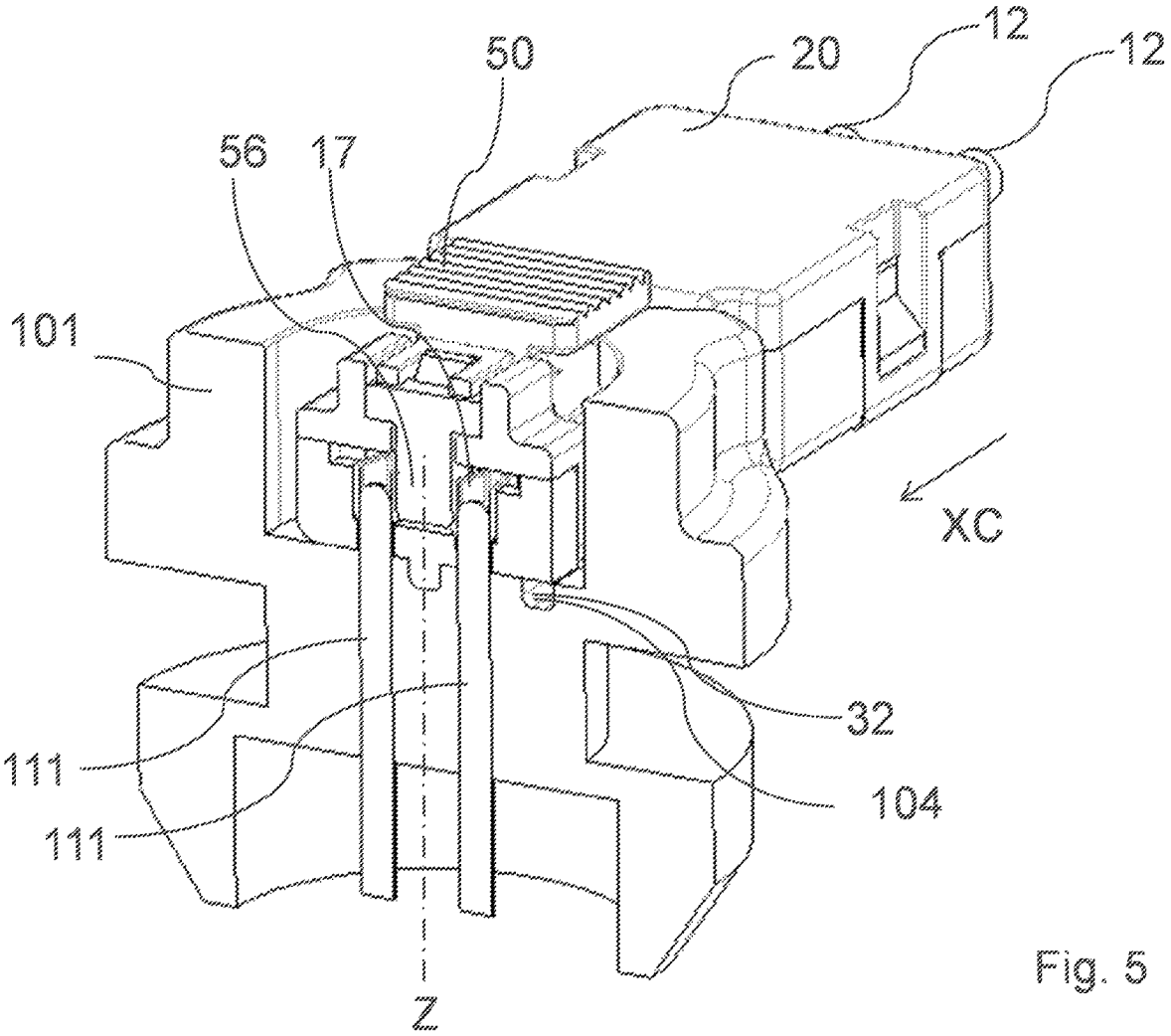
FIG. 5 shows a cut view of the connector assembly of FIG. 1*b* with a cut along the longitudinal axis, with the support device in a support position in accordance with an embodiment of the invention.

FIG. 5 shows a cut view of the connector assembly of FIG. 1*b* with a cut along the longitudinal axis. The support device is in the support position C. The contact surface 17 of the one elongated terminal 16 is arranged in an angle outward to the longitudinal axis X and wherein the counter-contact element 111 is pin shaped.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

That while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical connector comprising;

an elongated housing aligned on a longitudinal axis, surrounding an elongated terminal having a contact surface; and a terminal support device, attached on the elongated housing and movable longitudinally along the elongated housing from an open position to a support position, wherein the terminal support device increases a contact pressure of the contact surface, to a counter-contact element, when the electrical connector is mated to a counter-connector and the terminal support device is in the support position, wherein the elongated housing has an elongated opening and wherein the terminal support device protrudes from the inside of the elongated housing, through the elongated opening, to outward the elongated housing.

2. An electrical connector comprising;

an elongated housing aligned on a longitudinal axis, surrounding an elongated terminal having a contact surface; and a terminal support device, attached on the elongated housing and movable longitudinally along the elongated housing from an open position to a support position, wherein the terminal support device increases a contact pressure of the contact surface, to a counter-contact element, when the electrical connector is mated to a counter-connector and the terminal support device is in the support position, wherein the elongated housing comprises a locking opening, arranged in a flexible tong and the terminal support device comprises a first locking protrusion and a second locking protrusion protruding outward the elongated housing, wherein the first locking protrusion is located in the locking opening when the terminal support device is in the open position and wherein the first locking protrusion and the second locking protrusion are located in the locking opening when the terminal support device is in the support position.

3. An electrical connector, comprising;

an elongated housing aligned on a longitudinal axis, surrounding an elongated terminal having a contact surface; and a terminal support device, attached on the elongated housing and movable longitudinally along the elongated housing from an open position to a support position, wherein the terminal support device increases a contact pressure of the contact surface, to a counter-contact element, when the electrical connector is mated to a counter-connector and the terminal support device is in the support position, wherein the terminal support device comprises a support protrusion protruding perpendicular to the longitudinal axis inward the elongated housing.

4. The electrical connector according to claim 3, wherein the support protrusion comprises a flat activation surface for increasing said contact pressure and being aligned to the longitudinal axis.

5. The electrical connector according to claim 4, wherein the elongated terminal is aligned along the longitudinal axis of the elongated housing.

6. The electrical connector according to claim 5, wherein the elongated terminal comprises a straight portion and a bend portion.

7. The electrical connector according to claim 6, wherein the flat activation surface is arranged opposite the straight portion when the terminal support device is in the open position and wherein the flat activation surface contacts the bend portion when the terminal support device is in the support position.

8. An electrical connector, comprising;

an elongated housing aligned on a longitudinal axis, surrounding an elongated terminal having a contact surface; and a terminal support device, attached on the elongated housing and movable longitudinally along the elongated housing from an open position to a support position, wherein the terminal support device increases a contact pressure of the contact surface, to a counter-contact element, when the electrical connector is mated to a counter-connector and the terminal support device is in the support position, wherein the elongated housing comprises a bar, protruding in a mating direction along the longitudinal axis, having a third locking protrusion to lock the elongated housing to a locking opening in a flexible locking tong of said counter-connector.

9. The electrical connector according to claim 8, wherein the electrical connector comprises two elongated terminals and wherein the bar is arranged between the two elongated terminals.

10. An electrical connector, comprising;

an elongated housing aligned on a longitudinal axis, surrounding an elongated terminal having a contact surface; and a terminal support device, attached on the elongated housing and movable longitudinally along the elongated housing from an open position to a support position, wherein the terminal support device increases a contact pressure of the contact surface, to a counter-contact element, when the electrical connector is mated to a counter-connector and the terminal support device is in the support position, wherein the counter-connector comprises a plane surface, arranged perpendicular to a counter-connector axis and along to the longitudinal axis, wherein a part of the counter-contact element protrudes from the plane surface along the counter-connector axis.

11. The electrical connector according to claim 10, wherein a shroud surrounds, at least partly, the counter-contact element.

12. The electrical connector according to claim 11, wherein a length of the part of the counter-contact element protruding out of the plane surface, is less than 50% of an extension of the shroud from the plane surface along the counter-connector axis.

13. The electrical connector according to claim 12, wherein the plane surface, comprises a groove aligned along the longitudinal axis and wherein the electrical connector comprises a rib aligned along the longitudinal axis and wherein the rib is carried in the groove, when the electrical connector and the counter-connector are fully connected.

14. The electrical connector according to claim 13, wherein the contact surface of the elongated terminal is arranged in an angle outward to the longitudinal axis and wherein the counter-contact element is pin shaped.

* * * * *